United States Patent [19]

Rustin

[11] Patent Number: 5,031,085

[45] Date of Patent: Jul. 9, 1991

[54] LIGHT TOWER APPARATUS

[76] Inventor: Gregory E. Rustin, 3611 University Dr., Apt. 14A, Durham, N.C. 27707

[21] Appl. No.: 564,124

[22] Filed: Aug. 8, 1990

[51] Int. Cl.[5] ..... F21V 21/20

[52] U.S. Cl. ..... 362/401; 362/418; 362/431; 248/297.1; 248/123.1

[58] Field of Search ..... 362/401, 402, 403, 391, 362/431, 418; 248/123.1, 297.1

[56] References Cited

U.S. PATENT DOCUMENTS

| | | | |
|---|---|---|---|
| 456,859 | 7/1891 | Shank | 362/403 |
| 1,450,051 | 3/1923 | Sickles | 248/297.1 |
| 2,391,936 | 1/1946 | Wilson | 362/401 |
| 3,696,241 | 10/1972 | Meyer et al. | 362/401 |
| 3,763,368 | 10/1973 | Baggott | 362/401 |
| 3,911,267 | 10/1975 | Kiehn | 362/401 |
| 3,958,116 | 5/1976 | Jones | 362/401 |

*Primary Examiner*—James C. Yeung
*Attorney, Agent, or Firm*—Leon Gilden

[57] ABSTRACT

An apparatus wherein an elongate, vertically aligned mast includes an elongate slot directed through a forward wall of the mast, with a light boom reciprocatably mounted through the mast, with the light boom mounted to an endless cogged belt. The belt in operative association with a series of toothed pulley members, with a lowermost pulley member including a crank handle in operative association therethrough for permitting rotation of the belt organization. An access plate is mounted through a rear wall of the mast to permit selective securement of various light booms and associated lights to the belt, with a lowermost access plate permitting replacement of various counter-balance weights in association with the illumination members.

3 Claims, 4 Drawing Sheets

PRIOR ART

FIG. 3
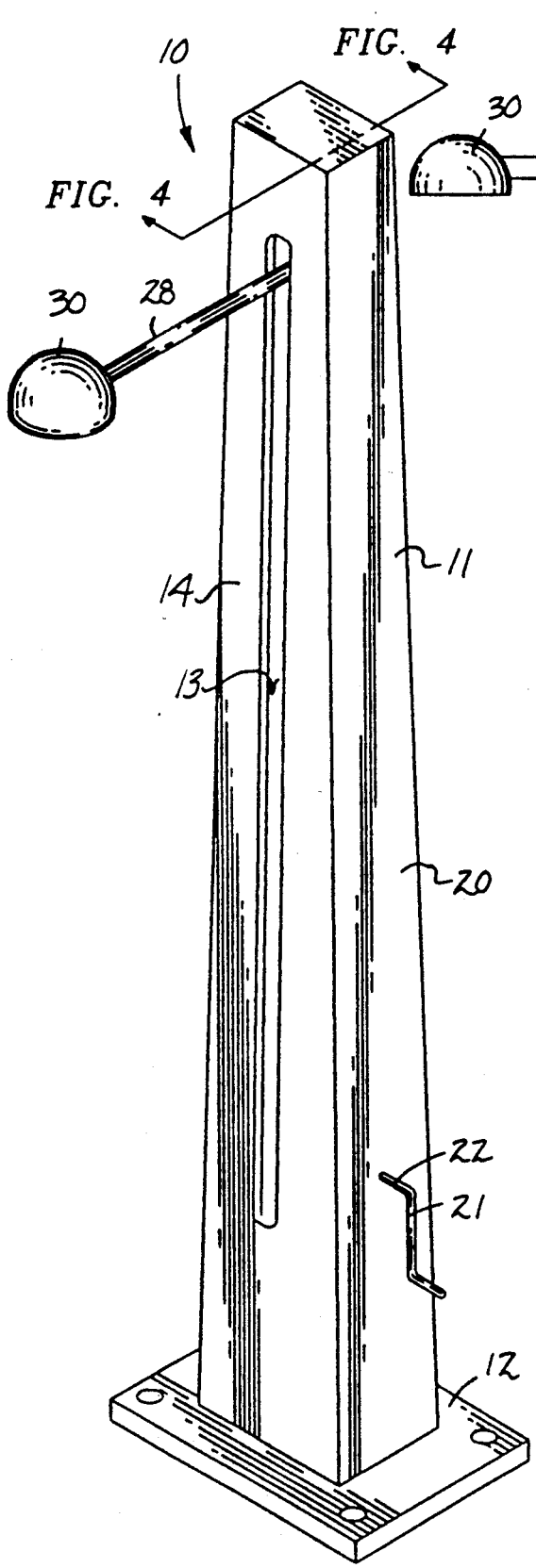
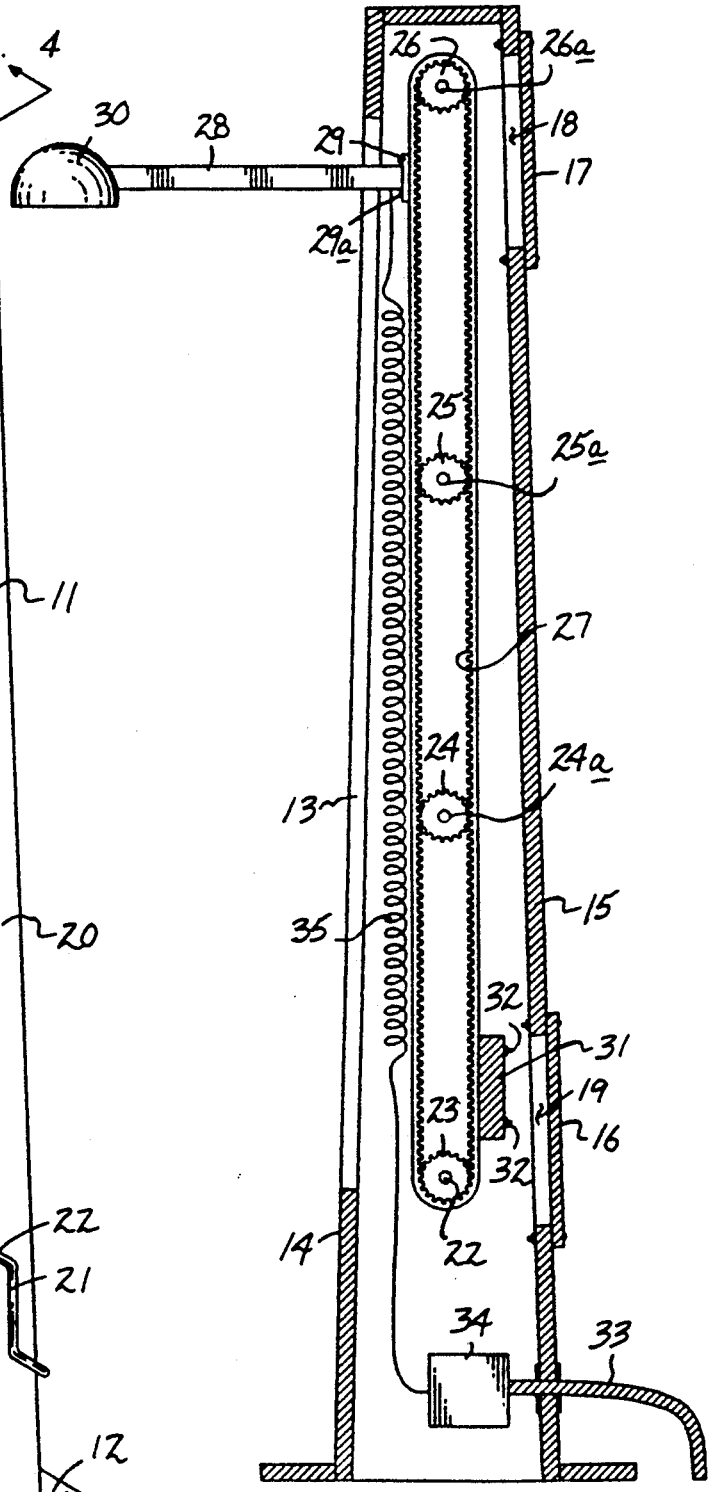
FIG. 4

LIGHT TOWER APPARATUS

BACKGROUND OF THE INVENTION

1. Field of the Invention

The field of invention relates to illumination organizations, and more particularly pertains to a new and improved light tower apparatus wherein the same permits vertical reciprocation of an illumination member to permit selective maintenance and replacement thereof.

2. Description of the Prior Art

In the maintenance and utilization of various illumination type organizations, access to an illumination head is desirable to permit access thereto. The raising and lowering of light fixtures by use of a winch and cable structure is set forth in the prior art and exemplified in U.S. Pat. No. 3,958,116 to Jones wherein a shaft is provided with an illumination member that is reciprocatably mounted throughout the shaft.

U.S. Pat. No. 3,911,267 to Kiehn sets forth an illumination must with apparatus to raise and lower a matrix of light members that are symmetrically and angularly formed about the mast.

U.S. Pat. No. 3,696,241 to Meyer, et al. sets forth a light tower wherein an annular array of lights and a counter-weight organization is provided.

U.S. Pat. No. 3,763,368 to Baggott sets forth a pull-down lamp that is mounted through a cable to a counter-weight.

U.S. Pat. No. 2,391,936 to Wilson sets forth a lighting fixture in operative association with a counter-weight through a cable organization.

As such, it may be appreciated that there continues to be a need for a new and improved light tower apparatus which addresses both the problems of ease of use as well as effectiveness in construction and in this respect, the present invention substantially fulfills this need.

SUMMARY OF THE INVENTION

In view of the foregoing disadvantages inherent in the known types of light tower apparatus now present in the prior art, the present invention provides a light tower apparatus wherein the same utilizes a replacement counter-weight organization in cooperative association with an illumination head mounted within a vertically oriented mast to permit maintenance and replacement of the illumination head as required. As such, the general purpose of the present invention, which will be described subsequently in greater detail, is to provide a new and improved light tower apparatus which has all the advantages of the prior art light tower apparatus and none of the disadvantages.

To attain this, the present invention provides an apparatus wherein an elongate, vertically aligned mast includes an elongate slot directed through a forward wall of the mast, with a light boom reciprocatably mounted through the mast, with the light boom mounted to an endless cogged belt. The belt in operative association with a series of toothed pulley members, with a lowermost pulley member including a crank handle in operative association therethrough for permitting rotation of the belt organization. An access plate is mounted through a rear wall of the mast to permit selective securement of various light booms and associated lights to the belt, with a lowermost access plate permitting replacement of various counter-balance weights in association with the illumination members.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved light tower apparatus which has all the advantages of the prior art light tower apparatus and none of the disadvantages.

It is another object of the present invention to provide a new and improved light tower apparatus which may be easily and efficiently manufactured and marketed.

It is further object of the present invention to provide a new and improved light tower apparatus which is of a durable and reliable construction.

An even further object of the present invention is to provide a new and improved light tower apparatus which is susceptible of a lower cost of manufacture with regard to both materials and labor, and which accordingly is then susceptible of low prices of sale to the consuming public, thereby making such light tower apparatus economically available to the buying public.

Still yet another object of the present invention is to provide a new and improved light tower apparatus which provides in the apparatuses and methods of the prior art some of the advantages thereof, while simultaneously overcoming some of the disadvantages normally associated therewith.

Still another object of the present invention is to provide a new and improved light tower apparatus wherein the same provides a gear driven toothed belt manually and selectively rotated to permit replacement and maintenance of an illumination head mounted to the belt structure of the apparatus.

These together with other objects of the invention, along with the various features of novelty which characterize the invention, are pointed out with particularity in the claims annexed to and forming a part of the disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention.

FIG. 4 is an orthographic view, taken along the lines 4—4 of FIG. 3 in the direction indicated by the arrows.

DESCRIPTION OF THE PREFERRED EMBODIMENT

Figure 1:
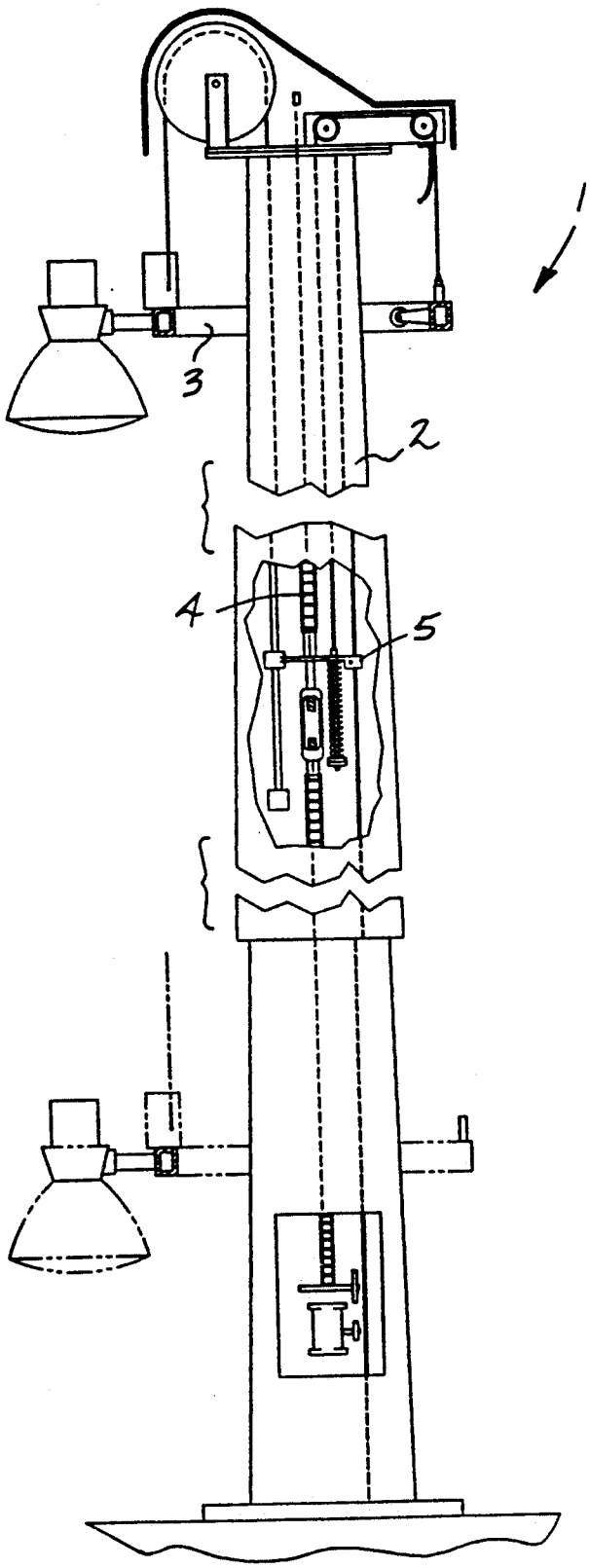
FIG. 1 is an orthographic view, taken in elevation, of a prior art light tower apparatus.
Figure 2:
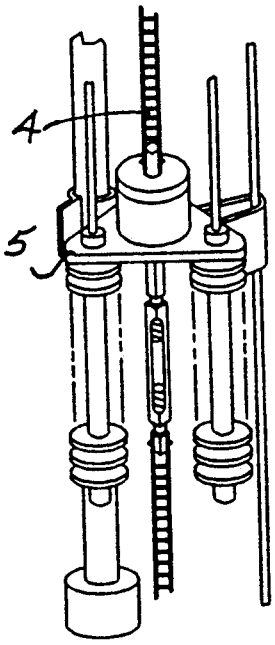
PRIOR ART FIG. 2
FIG. 2 is an enlarged isometric illustration of a connector plate organization utilized medially within the prior art light tower apparatus, as illustrated in FIG. 1.
Figure 5:
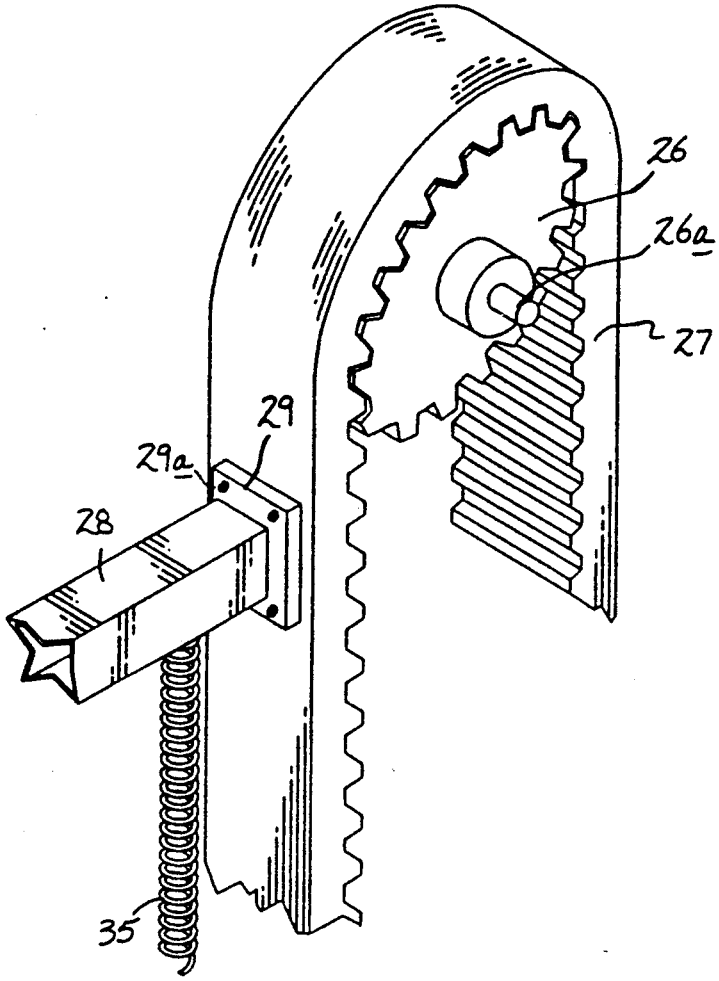
FIG. 5 is an isometric illustration of an uppermost end of the drive mechanism of the instant invention.

With reference now to the drawings, and in particular to FIGS. 1 to 8 thereof, a new and improved light tower apparatus embodying the principles and concepts of the present invention and generally designated by the reference numeral 10 will be described.

FIG. 1 illustrates a prior art light tower apparatus 1, wherein a mast structure 2 includes a light member 3 mounted through a cable and chain drive organization 4, with a transition plate 5 mounted medially thereof that reciprocates in cooperation to the raising and lowering of the illumination member 3, in a manner as set forth in U.S. Pat. No. 3,958,116.

More specifically, the light tower apparatus 10 of the instant invention essentially comprises an elongate axially aligned hollow mast 11 orthogonally mounted to a pedestal base 12 for securement to an underlying surface. The mast 11 includes an elongate slot 13 directed medially and longitudinally of a forward wall 14 of the mast. A rear wall 15 of the mast includes a bottom access plate 16 and a top access plate 17 removably mounted overlying a respective bottom and top access opening 19 and 18 respectively, as illustrated in FIG. 4. The top access opening 18 is aligned with an uppermost end of an endless cog belt 17, with the bottom axis opening 19 whose lowermost extent overlies a lowermost extent of the same endless cog belt 27 that is positioned medially and axially of the mast 11. A manually manipulatable crank handle 21 is orthogonally directed through a side wall 20 of the mast, wherein the crank handle 21 includes a crank handle drive shaft axle 22 extending through the side wall 20 defining a first axle of a first toothed pulley 23 in operative association within the lowermost loop of the cog belt 27. A second and third respective tooth pulley 24 and 25, with a respective second and third axle 24*a* and 25*a*, are positioned in a spaced relationship relative to one another and the first tooth pulley 23 and a fourth tooth pulley 26 that is in operative association with the uppermost loop of the cog belt 27 and includes f fourth axle 26*a*. The first, second, third, and fourth axles of the respective toothed pulleys 23, 24, 25 and 26 are arranged in a parallel relationship relative to one another. The access openings permit maintenance and access to the interior of the mast to permit selective replacement and maintenance of the cog belt structure.

Figure 6:
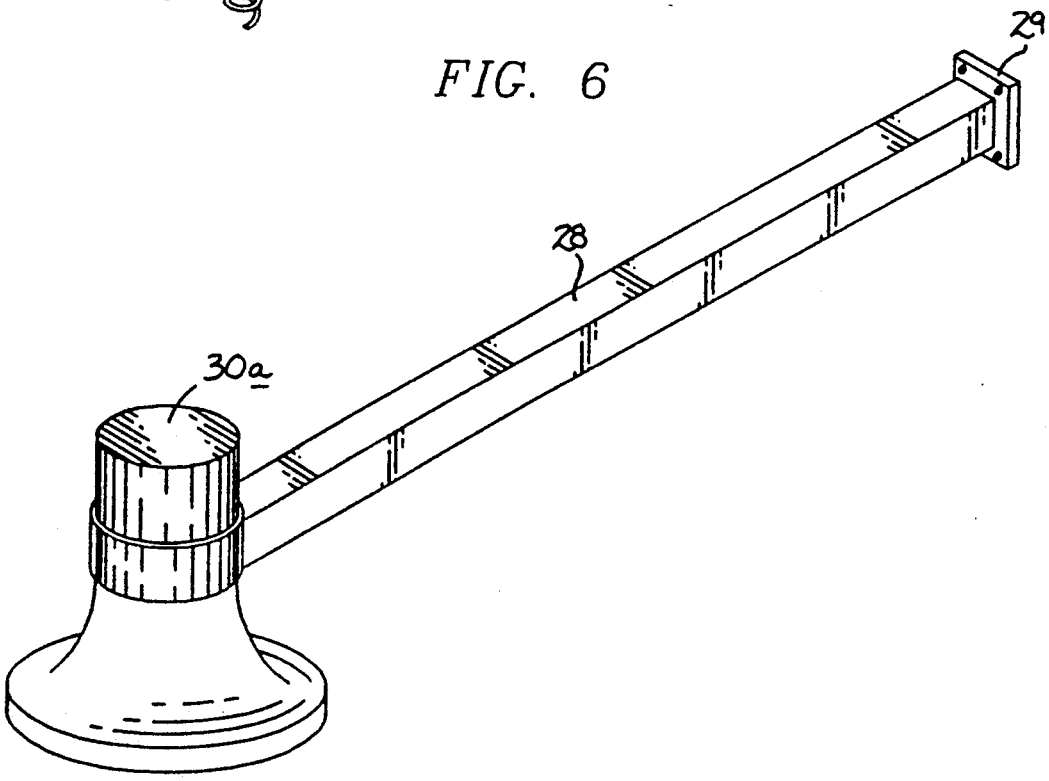
FIG. 6 is an isometric illustration of a replacement illumination member utilized by the instant invention.
Figure 7:
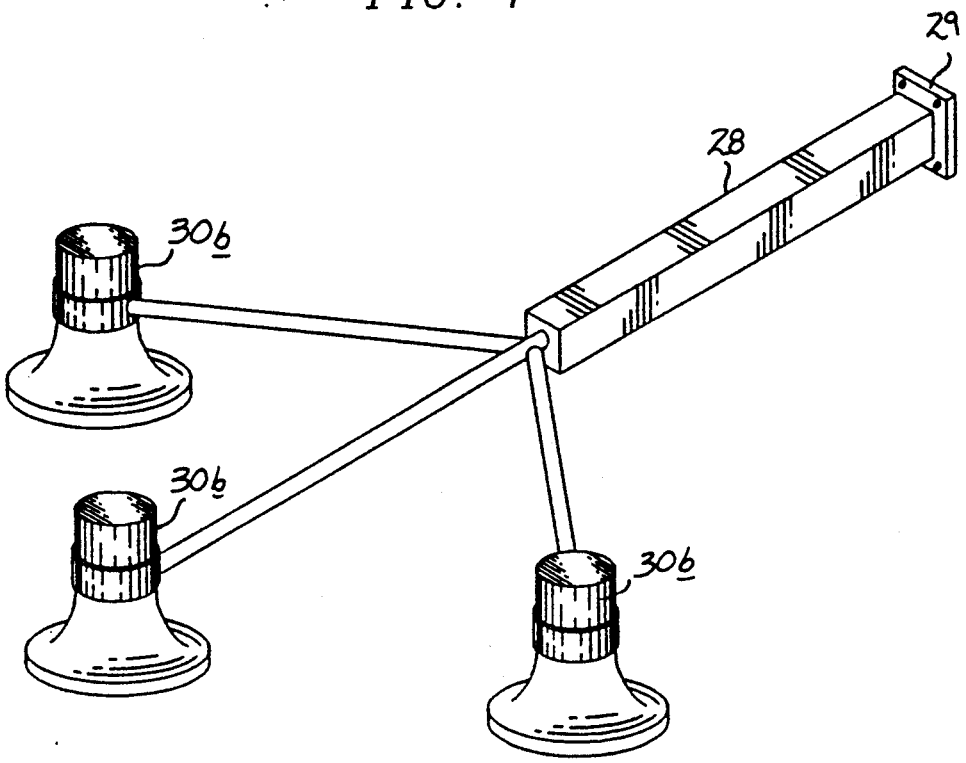
FIG. 7 is an isometric illustration of a further replacement member utilized by teh instant invention.
Figure 8:
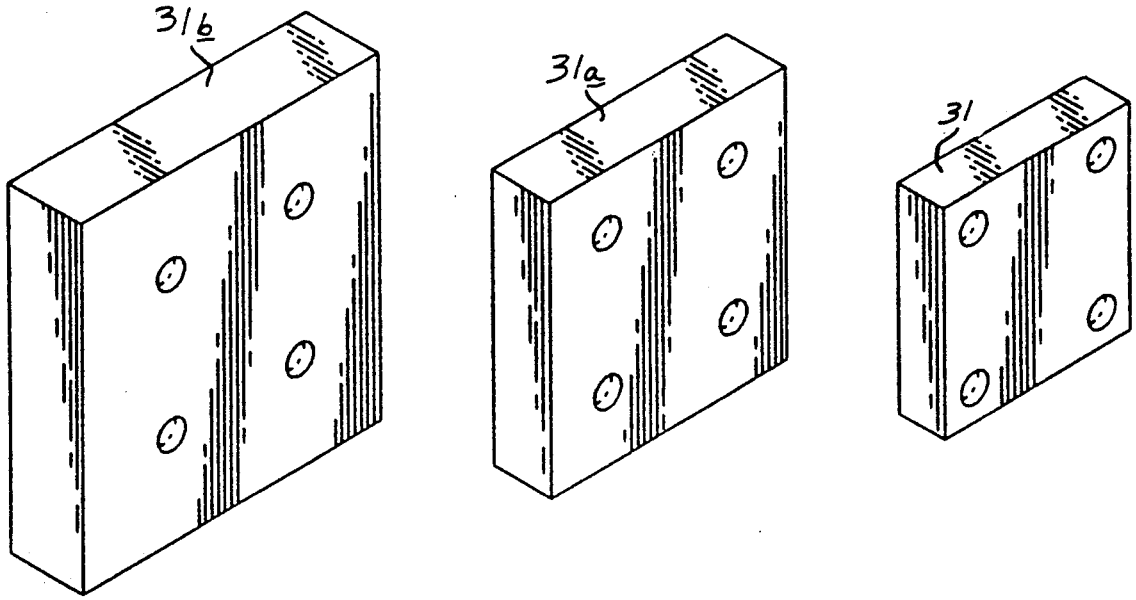
FIG. 8 is an isometric illustration of corresponding counter-weigth structures utilized in the replacement manner by the instant invention.

An elongate light fixture boom 28 includes a mounting flange 29 orthogonally mounted at a rear terminal end of the boom 28 that includes mounting flange fasteners 29*a* to permit replacement and selective securement of the mounting flange to an exterior surface of the cog belt 27 adjacent the fourth pulley 26 when an associated first counter-weight plate member 31 is in adjacent relationship relative to the first pulley 23. The first counter-weight 31 and the first lighting fixture defined by the boom 28, the mounting flange 29, and an illumination head 30 are of a substantially equal weight to enhance case of reciprocation of the first lighting fixture within the mast 11. Counter-weight plate fasteners 32 secure in a releasable manner, the first counter-weight plate 31 and one of a series of counter-weights 31, 31*a*, and 31*b* (see FIG. 8) in a replacement manner relative to the cog belt 27. An electrical conduit 33 is directed into a junction box 34 within a lowermost end of the mast 11, wherein an extensible memory retentent helically wound electrical cable 35 is in operative associated with the junction box 34 and the illumination head 30 to selectively extend and re-compact within the mast structure as the illumination head is reciprocated as required within the mast structure. FIG. 6 illustrates a second illumination head 30*a* of a second weight, wherein the illumination member, as illustrated in FIG. 6, substantially equals the second weight 31*a*, and wherein FIG. 7 illustrates a further modified lighting fixture including a trio of third illumination heads 30*b* mounted to the light fixture boom 28 to define a third weight substantially equal to the third weight 31*b*, wherein as illustrated the weights are of progressively increasing weights to compensate for the increasingly heavier light fixtures, as illustrated in FIGS. 3, 6, and 7 respectively.

It is understood therefore that maintenance of an associated light fixture is required, the crank handle 21 is merely rotated to permit downward displacement of the light fixture for ease of access thereto. Further, it is understood that the crank handle may be removed wherein a slip hex connection or the like may be utilized within the first axle structure of the first toothed pulley 23 to permit positioning of the crank handle therewithin, as required in a conventional manner.

As to the manner of usage and operation of the instant invention, the same should be apparent from the above disclosure, and accordingly no further discussion relative to the manner of usage and operation of the instant invention shall be required.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A light tower apparatus comprising, in combination, an elongate axially aligned hollow mast, the hollow mast including a forward wall, a rear wall spaced from the forward wall, and spaced side walls, with an elongate slot positioned medially and longitudinally of the forward wall, and an elongate endless drive belt axially mounted within the hollow mast, the endless drive belt including an upper loop and a lower loop, with a lower toothed pulley in operative engagement within the lower loop, and an upper pulley in operative engagement within the upper loop, wherein the lower toothed pulley includes a lower axle and the upper toothed pulley includes an upper axle, wherein the upper and lower axles are arranged parallel relative to one another. and a drive means directed through a side wall of the hollow mast in operative engagement with the lower axle to effect selective rotation of the lower toothed pulley and the drive belt, and a first light fixture mounted to the drive belt adjacent the upper pulley and a first counter-weight mounted to the drive belt adjacent the lower pulley, wherein the first light fixture and the first counter-weight are of substantially equal weight, and the first light fixture including a mounting flange selectively securable to the drive belt, and a boom member mounted to the mounting flange extending orthogonally relative to the mounting flange through the elongate slot, with a first illumination head mounted to a forward distal end of the boom member, and including a top access opening directed through the rear wall, with the top access opening overlying the upper toothed pulley and a bottom access opening directed through the forward wall overlying the lower toothed pulley, and a top access plate removably mounted overlying the top access opening, and a bottom access plate removably mounted overlying the bottom access opening.

2. An apparatus as set forth claim 1 including a second fixture member of a second weight replaceably mounted to the drive belt, and a third fixture member of a third weight replaceably mounted to the drive belt, with a second counter-weight replaceably mounted to the drive belt defining a weight substantially equal to a second weight defined by the second fixture member, and a third weight selectively mounted to the drive belt defining a third weight substantially equal to the third weight defined by the third fixture member to permit selective replacement of the first fixture member by the second fixture member or the third fixture member.

3. An apparatus as set forth in claim 2 including an electrical junction box positioned within a lowermost portion of the hollow mast, and an elongate extensible memory retentent helically wound electrical cable directing electrical current from the junction box to the first fixture member to permit selective extension and compaction of the cable upon a respective raising or lowering of the first light fixture member.

* * * * *